United States Patent [19]

Schuette

[11] 4,169,041

[45] Sep. 25, 1979

[54] FLUID COKING WITH THE ADDITION OF DISPERSIBLE METAL COMPOUNDS

[75] Inventor: William L. Schuette, Baton Rouge, La.

[73] Assignee: Exxon Research & Engineering Co., Florham Park, N.J.

[21] Appl. No.: 893,710

[22] Filed: Apr. 5, 1978

[51] Int. Cl.[2] ..... C10G 13/06; B01J 27/04

[52] U.S. Cl. ..... 208/108; 208/10; 208/112; 252/437

[58] Field of Search ..... 208/112, 108, 10, 8

[56] References Cited

U.S. PATENT DOCUMENTS

| | | | |
|---|---|---|---|
| 1,876,270 | 9/1932 | Zorn | 252/431 R |
| 2,091,831 | 8/1937 | Pongratz et al. | 208/108 |
| 2,885,350 | 5/1959 | Brown et al. | 208/127 |
| 2,888,393 | 5/1959 | Ballard et al. | 208/58 |
| 2,888,395 | 5/1959 | Henny | 208/111 |
| 3,131,142 | 4/1964 | Mills | 208/108 |
| 4,051,016 | 9/1977 | Metrailer et al. | 208/127 |
| 4,090,943 | 5/1978 | Moll et al. | 208/10 |
| 4,125,455 | 11/1978 | Herbstman | 208/108 |
| 4,134,825 | 1/1979 | Bearden et al. | 208/108 |
| 4,136,013 | 1/1979 | Moll et al. | 208/10 |

OTHER PUBLICATIONS

Bureau of Mines Bulletin 622 (1965), pp. 24–28.

*Primary Examiner*—Delbert E. Gantz
*Assistant Examiner*—G. E. Schmitkons
*Attorney, Agent, or Firm*—Marthe L. Gibbons

[57] ABSTRACT

A fluid hydrocoking process is provided in which certain metal compounds are dispersed in the coker chargestock. Preferred compounds are molybdenum compounds, for example, molybdenum naphthenate.

10 Claims, 1 Drawing Figure

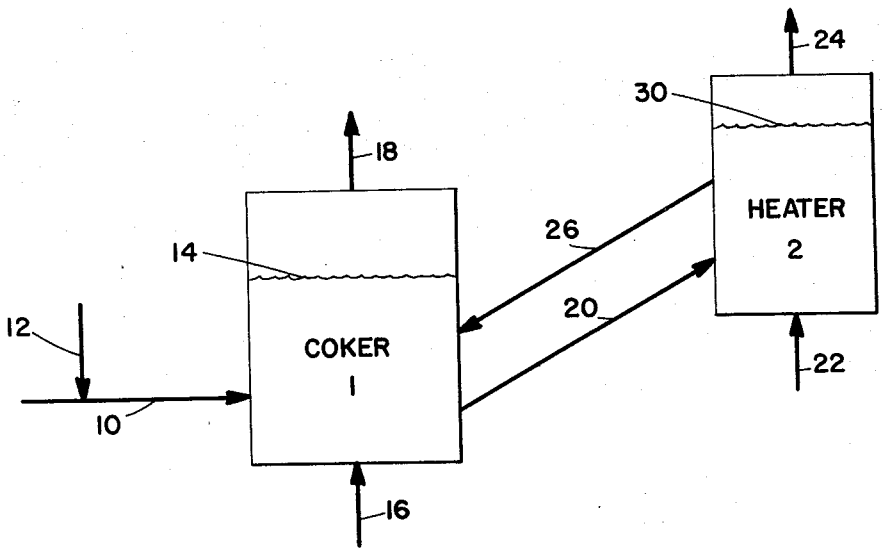
HEATER
2
COKER
1
24
22
30
26
20
18
16
14
10
12

FLUID COKING WITH THE ADDITION OF DISPERSIBLE METAL COMPOUNDS

BACKGROUND OF THE INVENTION

1. Field of the Invention

This invention relates to an improvement in a fluid hydrocoking process. More particularly, this invention relates to a fluid hydrocoking process in which certain metal compounds are added to the chargestock.

2. Description of the Prior Art

Fluid coking is a well known process which may be carried out with or without recycle of the heavier portion of the fluid coking zone effluent. As is well known in the art, the fluid coking process, as shown, for example, in U.S. Pat. No. 2,881,130, which is hereby incorporated by reference, uses a fluid coking vessel and an external heating vessel. A fluid bed of solids, preferably coke particles produced by the process having a size in the range from about 40 to about 1000 microns is maintained in the coking zone by the upward passage of fluidizing gas, usually steam, injected at a superficial velocity usually between 0.3 and 5 feet per second. The temperature in the fluid coking bed is maintained in the range of from about 850° to about 1400° F., preferably between 950° and 1100° F. by circulating solids (coke) to the heating vessel and back. The heavy oil to be converted is injected into the fluid bed and upon contact with the hot solids undergoes pyrolysis evolving lighter hydrocarbon products in vapor phase, including normally liquid hydrocarbons, and depositing a carbonaceous residue (coke) on the solid. The turbulence of the fluid bed normally results in substantially isothermal reaction conditions and thorough and rapid distribution of the heavy injected oil. Product vapors, after removal of entrained solids, are withdrawn overhead from the coking zone and sent to a scrubber and fractionator for cooling and separation. The end boiling point of distillate fraction obtained from the process is usually 1,050° to about 1,200° F. and the remaining heavy ends are usually recycled to extinction.

It is known to add hydrogen to a fluid coking zone, see, for example, U.S. Pat. Nos. 2,888,395 and 2,888,393.

It is also known to use oil soluble organometallic compounds in thermal cracking or in destructive hydrogenation of hydrocarbons, see, for example, U.S. Pat. No. 1,876,270.

It is also known to conduct cracking or destructive hydrogenation in the presence of oil soluble salts of acid organic compounds selected from the group consisting of carboxylic acids and phenol with a metal of Group VI and Group VIII of the Periodic Table, see, for example, U.S. Pat. No. 2,091,831.

A slurry hydrocracking process is also known in which an oil soluble compound of Groups IV to VIII is added to a heavy oil feed, see, for example, U.S. Pat. No. 3,131,142. It has now been found that the addition of a minor amount of certain metal compounds to the chargestock of a fluid coking process will provide advantages that will become apparent in the ensuing description.

SUMMARY OF THE INVENTION

In accordance with the invention, there is provided, in a fluid coking process comprising the steps of contacting a carbonaceous chargestock having a Conradson carbon content of at least 5 weight percent with hot fluidized solids in a fluidized coking bed contained in a coking zone maintained in a fluidized state by the introduction of a hydrogen-containing fluidizing gas and operated at coking conditions, including a total pressure ranging from about 20 to about 150 psig to produce a vapor phase product and a solid carbonaceous material which deposits on said fluidized solids, the improvement which comprises adding to said chargestock a metal compound selected from the group consisting of metal salts of organic acids, metal phenolates, metal halides, inorganic heteropoly acids and mixtures thereof wherein the metal constituent is selected from the group consisting of Groups IVB, VB, VIB, VIIB and VIII of the Periodic Table of Elements and mixtures thereof, the hydrogen pressure in said coking zone being at least about 20 psig.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, a carbonaceous material having a Conradson carbon content of at least 5 weight percent is passed by line 10 into a coking zone 1 in which is maintained a fluidized bed of solids (e.g. coke particles of 40 to 1000 microns in size) having an upper level indicated at 14. Suitable carbonaceous chargestocks for the present invention include heavy hydrocarbonaceous oils, heavy and reduced petroleum crudes, atmospheric residuum, vacuum residuum, pitch; asphalts; bitumen; other heavy hydrocarbon residues; coal; slurries of coal and oil; slurries of coal and water; liquid products derived from coal liquefaction processes and mixtures thereof. Typically such carbonaceous chargestocks have a Conradson carbon content of at least 5 weight percent, generally from about 5 to about 50 weight percent, preferably above 7 weight percent (as to Conradson carbon residue, see ASTM test D-189-65). A metal compound is added to the carbonaceous chargestock by line 12. Preferably, the metal compound is an oil soluble compound or an oil dispersible compound. Suitable metal compounds to be added to the chargestock of the present invention include metal salts of organic acids, such as acyclic and alicyclic aliphatic carboxylic acids containing 2 or more carbon atoms (e.g. naphthenic acids); metal phenolates; metal halides; inorganic heteropoly acids (e.g. phosphomolybdic acid) and mixtures thereof wherein the metal constituent is selected from the group consisting of Groups IVB, VB, VIB, VIIB and VIII of the Periodic Table of Elements, in accordance with the table published by E. H. Sargent and Co., copyright 1962, Dyna Slide Co. The preferred metal constituent of the added metal compound is selected from the group consisting of molybdenum, vanadium and chromium. The more preferred metal constituent of the metal compound is molybdenum. The preferred metal compounds are molybdenum naphthenate and phosphomolybdic acid. The added metal compound is dissolved or dispersed in the carbonaceous chargestock. When coal is used as the feed, the coal particles may be slurried in the hydrocarbonaceous oil to which the metal compound is added.

The metal compound is added to the carbonaceous chargestock in an amount ranging from about 10 to about 950 wppm, preferably from about 50 to about 500 wppm, more preferably from about 50 to about 200 wppm, said weight being calculated as if the compound existed as the elemental metal, based on the initial carbonaceous chargestock.

A hydrogen-containing fluidizing gas is admitted in the coking reactor 1 by line 16 in an amount sufficient to maintain a superficial gas velocity in the range of about 0.3 to about 5 feet per second. The hydrogen-containing fluidizing gas may also include steam, gaseous hydrocarbons, vaporized normally liquid hydrocarbons, or mixtures thereof. Typically, the hydrogen-containing fluidizing gas used will comprise steam. The fluidizing gas comprises added hydrogen in an amount sufficient so as to maintain a hydrogen pressure in the coking zone of at least about 20 psig, preferably about 30 to about 150 psig, including any hydrogen that may be produced in situ during the coking reaction. Coke at a temperature above the coking temperature, for example, at a temperature of 100 to 800 Fahrenheit degrees in excess of the actual operating temperature of the coking zone is admitted to coker 1 by line 26 in an amount sufficient to maintain the coking temperature in the range of about 850° to about 1400° F., preferably in the range of about 950° to 1100° F. The total pressure in the coking zone is maintained in the range of about 20 to about 150 pounds per square inch gauge (psig), preferably in the range of about 30 to about 150 psig. The lower portion of the coking reactor serves as a stripping zone to remove occluded hydrocarbons from the solids. A stream of solids is withdrawn from the stripping zone by line 20 and circulated to heater 2. The vaporous product includes gaseous hydrocarbons and normally liquid hydrocarbons as well as other gases which were introduced into the coking reactor as fluidizing gas. The vapor phase product is removed from coker 1 by line 18 for scrubbing and fractionation in a conventional way. If desired, at least a portion of the vaporous effluent may be recycled to the coker as fluidizing gas. A stream of heavy material condensed from the vaporous coker effluent may be recycled to the coker or the coker may be operated in a once-through manner, that is, without recycle of the heavy material to the coker.

A stream of stripped coke (commonly called cold coke) is withdrawn from the coker by line 20 and introduced to a fluid bed of hot coke having a level 30 in heater 2. The heater can be operated as a conventional coke burner such as disclosed in U.S. Pat. No. 2,881,130, which is hereby incorporated by reference. When the heater is operated as burner, an oxygen-containing gas, typically air, is introduced into heater 2 by line 22. The combustion of a portion of the solid carbonaceous deposition on the solids with the oxygen-containing gas provides the heat required to heat the colder particles. The temperature in the heating zone (burning zone) is maintained in the range of about 1200° to about 1700° F. Alternatively, heater 2 can be operated as a heat exchange zone such as disclosed in U.S. Pat. Nos. 3,661,543; 3,702,516 and 3,759,676, the teachings of which are hereby incorporated by reference. Hot coke is removed from the fluidized bed in heater 2 and recycled to the coking reactor by line 26 to supply the heat thereto.

While the process has been described for simplicity of description with respect to circulating coke as the fluidized solids, it is to be understood that the fluidized seed particles on which the coke is deposited may be silica, alumina, zirconia, magnesia, calcium oxide, alundum, mullite, bauxite or the like.

The following example is presented to illustrate the invention.

EXAMPLE

Comparative experiments were made in a stirred coking vessel with and without the use of molybdenum naphthenate as the added metal compound. The feed utilized in these experiments was a Tia Juana vacuum residuum having a Conradson carbon residue of 20.7 weight percent and an API gravity of 7.7. The conditions used and resulting products are summarized in the following table.

TABLE

| Run No. | 1 | 2 |
|---|---|---|
| Molybdenum naphthenate | None | 460 wppm |
| Temperature, °F. | 950 | 950 |
| $H_2$ Pressure, psig[1] | 30 | 30 |
| Feed rate | | |
| Oil, gm/min. | 30.9 | 24.2 |
| $H_2$, l/min. | 6.8 | 6.9 |
| Product Yields, wt. % | | |
| $C_4^-$ gas | 9.9 | 11.0 |
| Liquids | | |
| $C_5$/430° F. | 11.1 | 11.5 |
| 430/650° F. | 10.9 | 10.9 |
| 650/975° F. | 23.9 | 29.3 |
| 955° F.+ | 17.1 | 17.9 |
| TOTAL | 63.0 | 69.6 |
| Coke | 22.1 | 19.1 |

[1]This hydrogen pressure was also the total pressure.

As can be seen from the data in the table, Run No. 2, which is a run in accordance with the present invention, yielded less coke and more liquid products than comparative Run 1.

What is claimed is:

1. In a fluid coking process comprising the steps of contacting a carbonaceous chargestock having a Conradson carbon content of at least 5 weight percent with hot fluidized solids in a fluidized coking bed contained in a coking zone maintained in a fluidized state by the introduction of a hydrogen-containing fluidizing gas and operated at coking conditions, including a total pressure ranging from about 20 to about 150 psig, to produce a vapor phase product and a solid carbonaceous material which deposits on said fluidized solids, the improvement which comprises adding to said chargestock a metal compound selected from the group consisting of metal salts of organic acids, metal phenolates, metal halides, inorganic heteropoly acids and mixtures thereof wherein the metal constituent is selected from the group consisting of Groups IVB, VB, VIB, VIIB and VIII of the Periodic Table of Elements and mixtures thereof, the hydrogen pressure in said coking zone being at least about 20 psig.

2. The process of claim 1 wherein said metal constituent of said added metal compound is molybdenum.

3. The process of claim 1 wherein said added metal compound is a salt of a naphthenic acid.

4. The process of claim 1 wherein said added metal compound is molybdenum naphthenate.

5. The process of claim 1 wherein said added metal compound is phosphomolybdic acid.

6. The process of claim 1 wherein said added metal compound is added to said chargestock in an amount ranging from about 10 to about 950 wppm, calculated as the elemental metal, based on said chargestock.

7. The process of claim 1 wherein said hydrogen in said fluidizing gas is introduced into said coking zone in an amount sufficient to provide in said coking zone a total hydrogen pressure ranging from about 30 to about 150 psig.

8. The process of claim 1 wherein said coking zone is maintained at a temperature ranging from about 850° to about 1400° F.

9. The process of claim 1 wherein said coking zone is maintained at a temperature ranging from about 950° to about 1100° F.

10. In a fluid coking process comprising the steps of contacting a carbonaceous chargestock having a Conradson carbon content of at least 5 weight percent with hot fluidized solids in a fluidized coking bed contained in a coking zone maintained in a fluidized state by the introduction of a hydrogen-containing fluidizing gas and operated at fluid coking conditions, including a temperature ranging from about 850° to about 1400° F. and a total pressure ranging from about 30 to about 150 psig, to produce a vapor phase product and a solid carbonaceous material which deposits on said fluidized solids, the improvement which comprises adding to said chargestock a compound selected from the group consisting of molybdenum naphthenate and phosphomolybdic acid, and said fluidizing gas introduced into said coking zone comprising a sufficient amount of hydrogen to maintain in said coking zone a hydrogen pressure ranging from about 30 to about 150 psig.

* * * * *